US011254458B2

(12) United States Patent
Häring et al.

(10) Patent No.: US 11,254,458 B2
(45) Date of Patent: Feb. 22, 2022

(54) PACKAGING MACHINE WITH HEATED GRID

(71) Applicant: Multivac Sepp Haggenmüller SE & Co. KG, Wolfertschwenden (DE)

(72) Inventors: Rainer Häring, Lauben (DE); Maximilian Brunner, Kempten (DE); Florian Frühsammer, Kempten (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 308 days.

(21) Appl. No.: 16/395,724

(22) Filed: Apr. 26, 2019

(65) Prior Publication Data

US 2019/0329919 A1 Oct. 31, 2019

(30) Foreign Application Priority Data

Apr. 27, 2018 (EP) ..... 18169828

(51) Int. Cl.
*B65B 31/02* (2006.01)

(52) U.S. Cl.
CPC ..... *B65B 31/024* (2013.01)

(58) Field of Classification Search
CPC ..... B65B 31/024; B65B 31/04; B65B 31/048; B65B 25/001; B65D 81/2038; B65D 81/20
USPC ..... 53/432, 512, 434, 86, 510
See application file for complete search history.

(56) References Cited

U.S. PATENT DOCUMENTS

| | | | | |
|---|---|---|---|---|
| 4,471,599 | A * | 9/1984 | Mugnai | B65B 53/06 53/434 |
| 5,533,341 | A | 7/1996 | Schvester et al. | |
| 6,519,919 | B1 | 2/2003 | Takenouchi et al. | |
| 7,464,521 | B2 * | 12/2008 | Koke | B65B 31/021 53/202 |
| 10,913,562 | B2 * | 2/2021 | Gabler | B65B 31/04 |
| 2004/0139701 | A1 * | 7/2004 | Cady | B29C 65/7461 53/434 |
| 2006/0272291 | A1 * | 12/2006 | Koke | B65B 31/024 53/432 |
| 2017/0107004 | A1 * | 4/2017 | Bocks | B65B 31/024 |

(Continued)

FOREIGN PATENT DOCUMENTS

| | | | |
|---|---|---|---|
| DE | 102015002421 | A1 | 9/2016 |
| EP | 3162718 | A1 | 5/2017 |

OTHER PUBLICATIONS

Grid | Definition of Grid by Merriam-Webster—Retrieved from URL https://www.merriam-webster.com/dictionary/grid on Apr. 26, 2021 (Year: 2021).*

(Continued)

*Primary Examiner* — Valentin Neacsu
(74) *Attorney, Agent, or Firm* — Brooks Kushman P.C.

(57) ABSTRACT

A packaging machine for packaging products under vacuum, the packaging machine comprising a lid and a chamber bottom which together form a chamber, the chamber bottom having formed therein a suction opening which can be closed in a gas-tight manner and to which a suction device for evacuating the chamber is connected. An electrically heatable grid is arranged on the suction opening to prevent ice forming near or around the suction opening during evacuation of the chamber.

19 Claims, 3 Drawing Sheets

(56) References Cited

U.S. PATENT DOCUMENTS

2018/0155074 A1* 6/2018 Gabler ..... B65B 31/028

OTHER PUBLICATIONS

Orientation | Definition of Orientation by Merriam-Webster—Retrieved from URL https://www.merriam-webster.com/dictionary/orientation on Apr. 26, 2021 (Year: 2021).*
DIRECT—Merriam Webster Dictionary, retrieved online from URL https://www.merriam-webster.com/dictionary/direct on Aug. 30, 2021 (Year: 2021).*
DIRECTLY—Merriam Webster Dictionary, retrieved online from URL https://www.merriam-webster.com/dictionary/directly on Aug. 30, 2021 (Year: 2021).*
ABOVE—Merriam Webster Dictionary, retrieved online from URL https://www.merriam-webster.com/dictionary/above on Aug. 30, 2021 (Year: 2021).*

* cited by examiner

PACKAGING MACHINE WITH HEATED GRID

CROSS-REFERENCE TO RELATED APPLICATIONS

This application claims priority to European Patent Application No. 18169828.3 filed on Apr. 27, 2018 to Rainer Haring, Maximilian Brunner and Florian Frühsammer, currently pending, the entire disclosure of which is incorporated herein by reference.

FIELD OF THE INVENTION

The present invention relates to a packaging machine for packaging products under vacuum.

BACKGROUND OF THE INVENTION

Products, especially food products, are often packaged under vacuum to increase shelf life and make product presentation advantageous. For this purpose, packaging machines are used which evacuate a product package with a product located therein and then seal it. For this purpose, a vacuum is created in an otherwise gas-tightly closed chamber by extracting the air from the chamber using a suction device. A suction opening which is expediently formed in the chamber bottom serves as an air outlet. The packaging machine can be designed as an individual device into which the product packages are manually inserted, or as part of an automated production line in which the product packages are transported into the packaging machine by using a conveyor belt. Such a packaging machine is known from EP 2 110 321 B1.

A disadvantage of such packaging machines is that when the air is sucked out of the chamber at the suction opening, a local increase in flow velocity occurs due to the narrowing of the cross-section and thus a decrease in static pressure with a simultaneous decrease in temperature. This effect often leads to an icing of the suction opening.

SUMMARY OF THE INVENTION

It is the object of the invention to provide a packaging machine in which the operation of the machine is improved.

A packaging machine according to the invention for packaging products under vacuum may include a lid and a chamber bottom which together form a chamber, wherein the chamber bottom has formed therein a suction opening which can be closed in a gas-tight manner and to which a suction device for evacuating the chamber is connected. "At" or proximate to the suction opening (i.e. in the area of the suction opening) an electrically heatable grid may be arranged to heat the suction opening when evacuating the chamber. Thus, despite the cooling effect described above, there is no ice formation at the suction opening. This prevents further narrowing of the suction opening due to adhering ice. Also a closing of the suction opening by a valve-like element of the suction device, as described in the cited prior art, remains possible. In addition, damage to the suction device, in particular to a vacuum pump, by detaching ice is prevented.

The grid may preferably located in or above the suction opening. Thus the heat radiation of the grid can heat up the edges of the suction opening, which also contributes to the desired effect, namely the prevention of ice formation.

In an advantageous variant, the grid may be mounted on an electrically insulating frame. Since the grid itself may be current-carrying and usually not covered with insulation, it can nevertheless be mounted on the chamber bottom or the edges of the suction opening. For reasons of hygiene and stability, the chamber bottom in which the suction opening may be formed may be usually made of a metal such as stainless steel. By mounting the grid on an electrically insulating frame, there may be no conductive connection between grid and chamber bottom and thus impairment of other electronic components of the packaging machine or of an operator by electric current may be ruled out.

Ideally, the frame should rest substantially flush on the chamber bottom and completely surround the suction opening, so that all extracted air flows through the grid during evacuation. This allows the device to be as efficient as possible, as only air that has passed through the heated grid reaches the suction opening.

In a common variant, the grid may be fixed at a first and a second end with vacuum-tightly installed contact pins protruding through the chamber bottom. The contact pins are used to mechanically fix the grid and the insulating frame to the chamber bottom so that all three components are flush with each other and an air passage between the surfaces with which they lie on top of each other may be prevented. The fastening can here be done via screw connections, wherein the grid and the insulating frame each have holes or recesses through which a screw can be inserted and then screwed to an internal thread in the contact pin. Thus the connection can be released again and the components can be exchanged if necessary.

In a typical variant, a power supply for supplying the grid with approx. 80 to 800 watts of electrical power, preferably 400 to 600 watts, may be provided. This means that sufficient electrical power may be available matching the size and geometry of the grid to enable resistance heating of the grid. Thus, sufficient electrical current also flows through the lateral areas from the first to the second end of the grid.

In an appropriate variant, the contact pins make an electrical connection between the grid and the power supply, wherein the contact pins are electrically insulated against the chamber bottom. For this purpose, the contact pins have, for example, a core made of electrically conductive material and a sheath made of electrically insulating material. This allows the current to pass through the chamber floor to the grid without electricity being transferred to the chamber bottom.

In a preferred variant, the power supply may have a possibly regularly recurring switch-on duration of approx. 0.5 to 1.5 seconds. Thus the required heating power may be available within a short time and it may be sufficient to switch on the power supply of the grid only for this time before the evacuation process and during it. Once the evacuating operation has been finished, the power supply can be switched off again. Thus the power consumption may be limited to the necessary minimum, but the cycle times of the packaging machine are not affected thereby.

Typically, the grid may be made of an electrically conductive material approved for the food industry, in particular stainless steel. Due to its conductivity, the material may be therefore suitable for resistance heating, but does not release any substances into the environment due to heating. This means that the products to be packaged are not adversely affected.

In another variant, the grid has a length of approx. 50 to 120 mm and a width of approx. 20 to 80 mm. The grid dimensions are primarily determined by the size of the suction opening and may slightly exceed it, if necessary, in order to completely span the suction opening. For example, the grid and the insulating frame may have an essentially rectangular shape with a longer and a shorter side. In order to apply current evenly to the grid, the contact pins are usually arranged on the short sides. Due to the evolving resistance, the current flows almost uniformly through all grid struts from the first to the second short side of the grid.

In a conventional variant, the grid comprises webs which, in particular, have a width and a height of approx. 0.5 to 1.5 mm. The dimensions of the webs are chosen so that, when a suitable electrical voltage may be applied, they experience heating due to their resistance with the best possible efficiency.

In a favorable variant, the webs have a distance of approx. 8 to 10 mm from each other. This ensures that the air flow through the suction opening is not reduced by the grid.

In another typical variant, the packaging machine may be a chamber belt machine. It may be a component of an automated production line and the product packages to be evacuated are conveyed to the chamber using a conveyor belt in order to be evacuated and sealed there. This enables high cycle times and thus a high product output without manual intervention. Other aspects and advantages of the present invention will be apparent from the following detailed description of the preferred embodiments and the accompanying drawing figures.

DESCRIPTION OF THE SEVERAL VIEWS OF THE DRAWINGS

In the following, an advantageous embodiment of the present invention will be explained in more detail making reference to a drawing, in which the individual figures show.

DETAILED DESCRIPTION OF THE INVENTION

Figure 1:
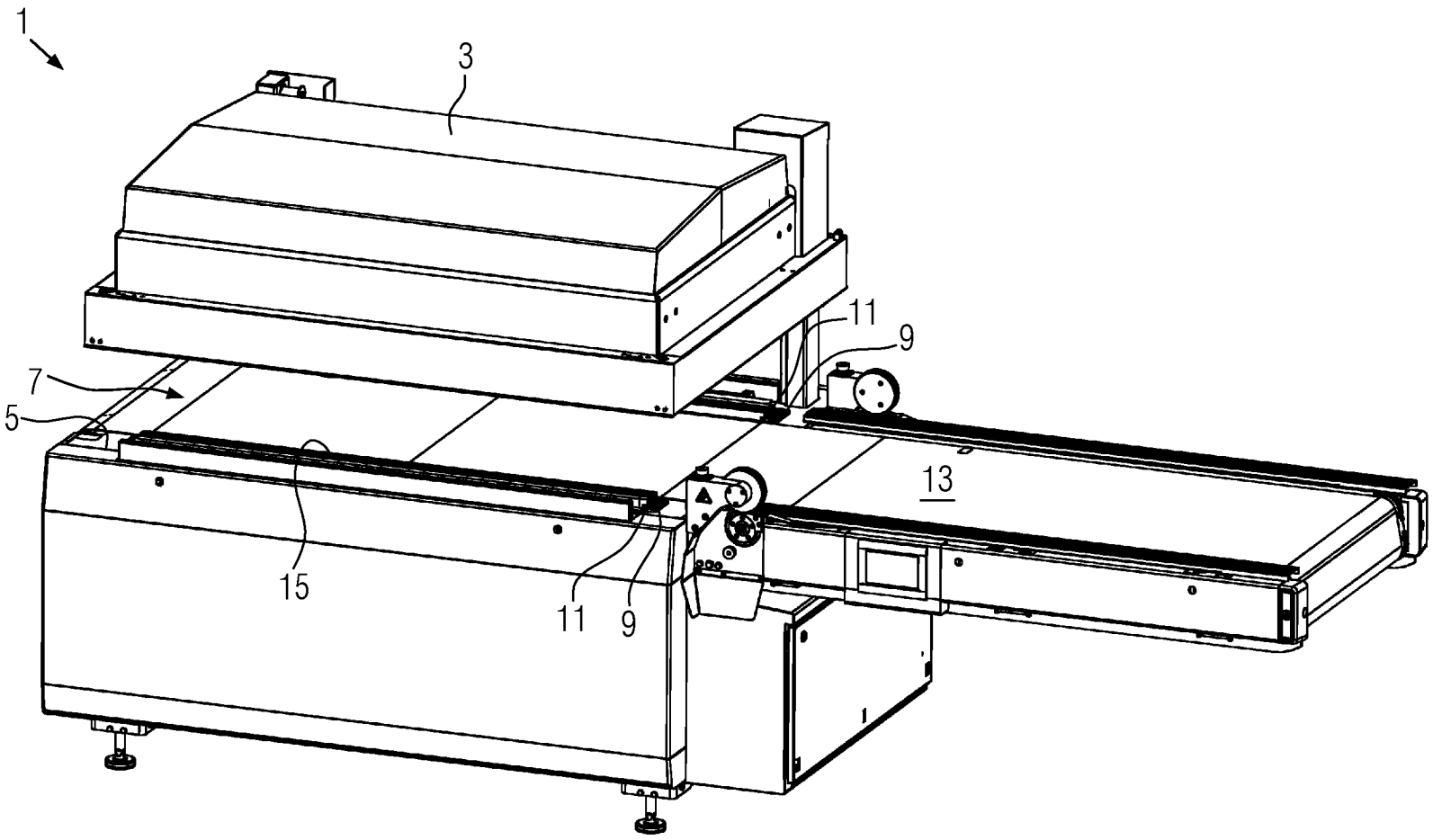
FIG. 1 is a perspective view of one embodiment of a packaging machine in the form of a chamber belt machine in accordance with the teachings of the present disclosure.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a packaging machine 1 in the form of a chamber belt machine with a vertically movable lid 3 and a chamber bottom 5. If the lid 3 is lowered onto the chamber bottom 5, a chamber 7 is formed, which seals gas-tight between lid 3 and chamber bottom 5. In this example, two suction openings 9 are formed in the chamber bottom 5, above each of which a heatable grid 11 is arranged. The chamber 7 is evacuated via the suction openings 9. The product packages to be evacuated are transported on a conveyor belt 13 into the chamber 7. The ends of a product package can be guided over a sealing bar 15 in such a way that the product package can be permanently closed by heat sealing after a vacuum has formed in the chamber 7.

Figure 2:
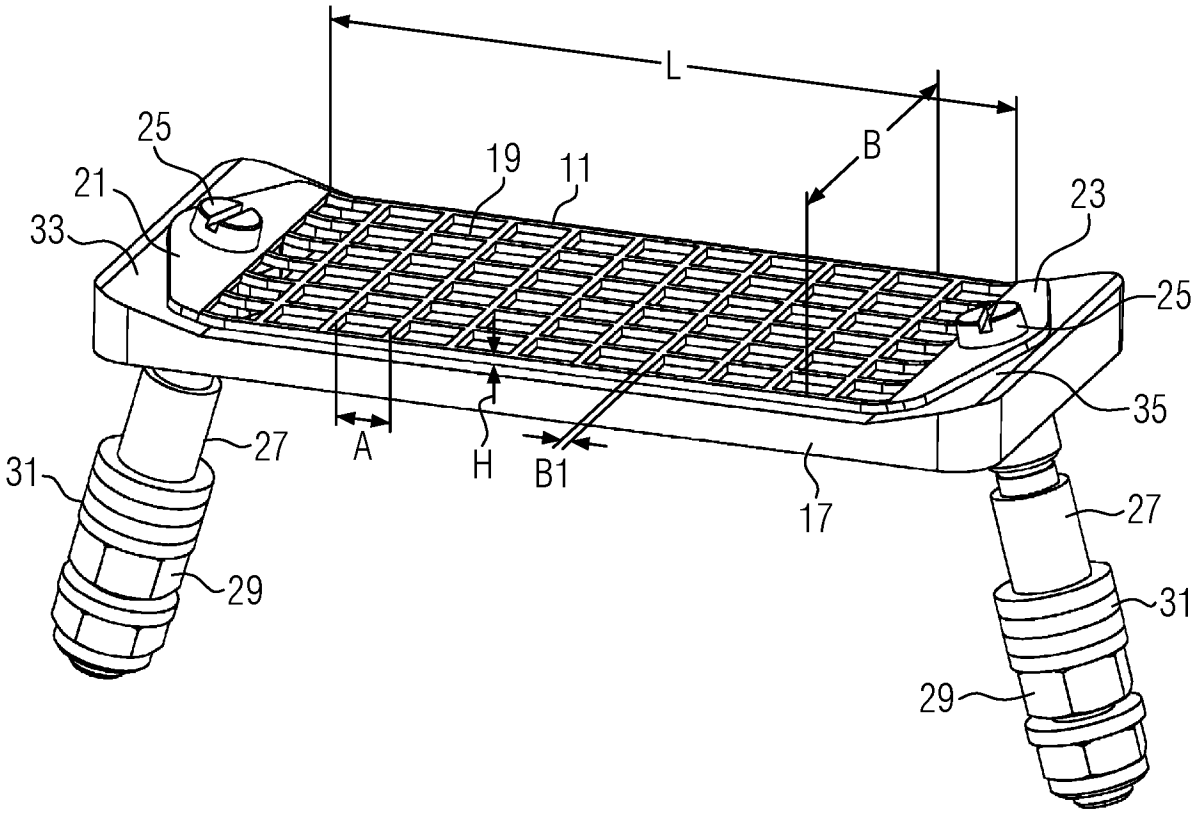
FIG. 2 is a perspective view of one embodiment of a heatable grid fixed onto an insulating frame by two contact pins in accordance with the teachings of the present disclosure.

FIG. 2 shows the heatable grid 11 arranged on an insulating frame 17. The grid 11 has webs 19 which extend in longitudinal and transverse direction. According to the dimensions described above, the grid 11 has a length L and a width B. The webs 19 have a height H, a width B1 and a distance A to each other. A first and a second massive end 21, 23 are triangular in shape on the substantially rectangular grid 11. The two ends 21, 23 are each screwed with a screw 25 to the frame 17 and a respective contact pin 27. The contact pins 27 are each clamped against the chamber bottom 5 by using a respective screw nut 29, so that the frame 17 also rests flush on the chamber bottom 5. Spacers 31 are used to adapt to chamber bottoms 5 of different thicknesses. As can be seen, the frame 17 also has a massively shaped first and second end 33, 35 on its short sides. This ensures a stable screw connection with the contact pins 27. On its long sides, however, the grid 11 rests only on a relatively narrow side wall of the frame 17.

The first and second ends 33, 35 of the insulating frame 17 each have a slope on its upper side, which makes it possible to mount the contact pins 27 with a corresponding inclination. The first and second ends 21, 23 of the grid 11 are bent upwards to match the slope of the first and second ends 33, 35 of the insulating frame 17. Thus, as shown in FIG. 3, for assembly, for example for tightening the nuts 29, the contact pins 27 are also easily accessible adjacent to a suction device.

Figure 3:
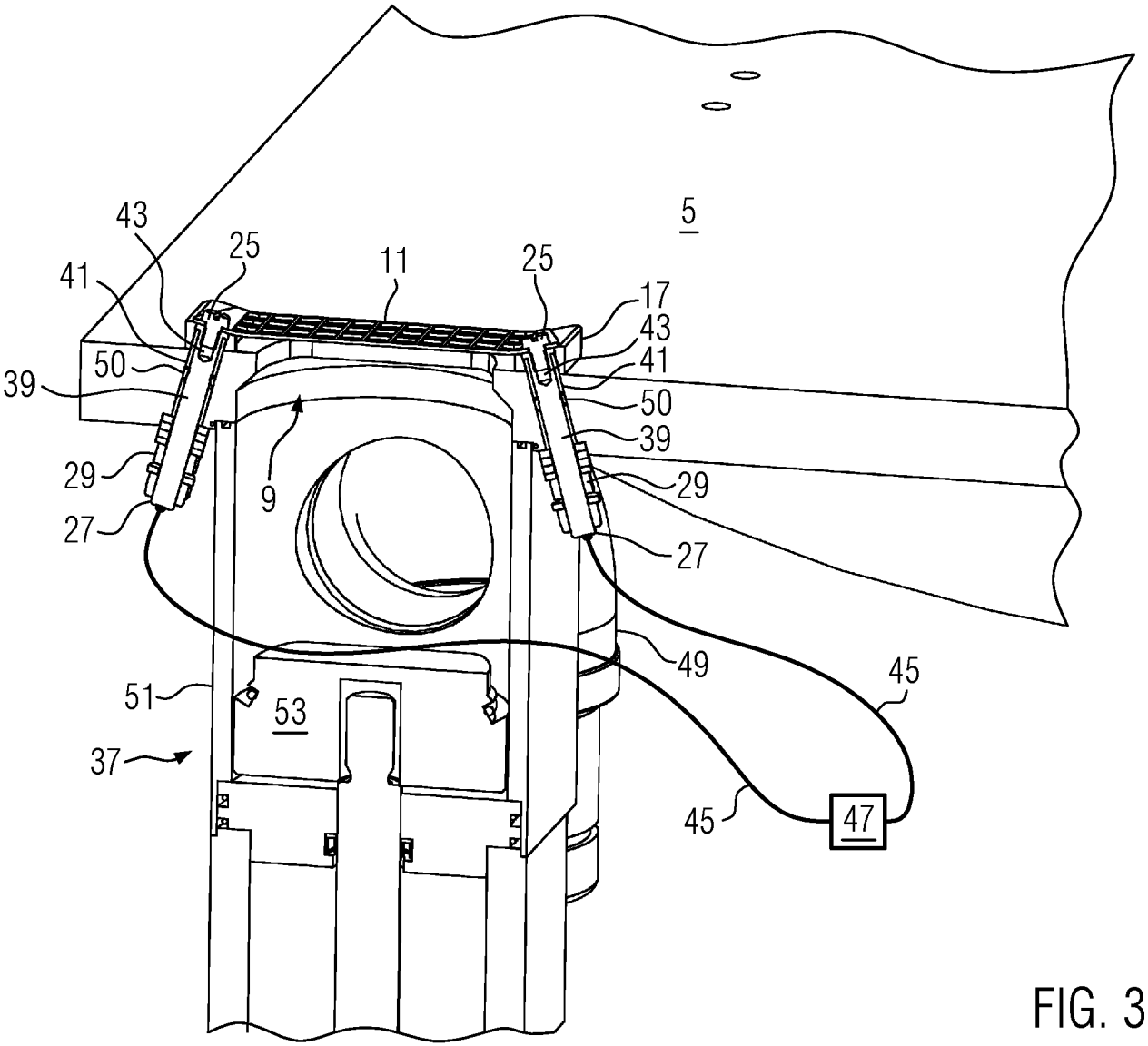
FIG. 3 is a perspective view of the embodiment of FIG. 2 that shows a section through a suction opening with heatable grid and part of a suction device disposed thereon.

FIG. 3 shows a section through the suction opening 9 with a heatable grid 11 arranged on it and a part of a suction device 37. The grid 11 is mounted on the frame 17 and thus electrically insulated from the chamber bottom 5. At the same time, the frame 17 is flush with the chamber bottom 5, so that only air which has passed through the grid 11 and has thus been heated reaches the suction opening 9. The contact pins 27 comprise an electrically conductive inner part 39 and an insulation 41 surrounding the inner part 39. The inner part 39 has arranged therein a hole 43 with an internal thread into which the screw 25 is screwed to connect the grid 11 and the frame 17 with the contact pin 27.

There are holes or recesses in the chamber bottom 5, through which the contact pins 27 are passed. On the outer or lower side of the chamber bottom 5, the contact pin 27 is tightened using the screw nut 29. The vacuum tightness at the feed-through of the contact pins 27 is ensured by seals 50 surrounding the contact pins 27.

Power supply lines 45 are expediently connected to the electrically conductive inner part 39, for example by soldering, welding or screwing. A power supply 47, for example a transformer, provides the required electrical energy. The suction device 37 comprises an air duct 49 through which the air is extracted from the chamber 7 by using a vacuum pump (not shown). A piston 53, which can be moved up and down, is arranged in a cylinder-like guide 51 to close the suction opening 9 in a gas-tight manner, and closes the suction opening 9 in a form-fit manner in an uppermost position.

Based on the embodiments of a packaging machine 1 shown above, many variations of the same are conceivable. For example, the grid 11 and the frame 17 can be extended in their longitudinal extension, so that the contact pins 17 can be oriented substantially perpendicular to the chamber bottom 5, and assembly, especially the tightening of the screw nuts 29, is nevertheless possible. This means that there is no need to incline the first and second ends 21, 23 of the grid 11 and the first and second ends 33, 35 of the frame 17. At the same time, the first and second ends 21, 23 of the grid 11 and the first and second ends 33, 35 of the frame 17, i.e. the massively formed sections, could be enlarged correspondingly so that the size of the air flow area of the grid 1 remains unchanged. Although it is advantageous, as explained in the cited prior art, to arrange the suction openings 9 in the chamber bottom 5, it is also possible to form the suction openings 9 at other suitable places of the chamber 7, for example on the top or side surfaces of the lid 3. Further modifications to the structure of the packaging machine 1 itself are also possible in a variety of ways. For example, the lid 3 can be hinged to a hinge on the chamber bottom 5 or a frame of the packaging machine 1 and opened and closed by unfolding and folding instead of by vertical displacement. Furthermore, instead of intersecting webs, the grid 11 in the sense of the invention can comprise webs in a different orientation to each other, for example parallel along only one direction. In addition, the webs 19 can be completely dispensed with, so that the grid 11, preferably depending on the shape of the suction opening 9, is essentially a resistance-heated frame or ring, which in particular heats the edge of the suction opening 9 so that ice formation is prevented there.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A packaging machine for packaging products under vacuum, the packaging machine comprising:

a lid and a chamber bottom, which together define a chamber, the chamber bottom including a suction opening having an axis, wherein the suction opening is configured to be in an open state and a closed state, wherein in the closed state, the suction opening is closed in a gas-tight manner;

a suction device operably connected to the suction opening, the suction device operable to evacuate the chamber when the suction opening is in the open state; and an electrically heatable grid disposed in or in alignment with the suction opening and the axis and operable to prevent ice formation at the suction opening.

2. The packaging machine according to claim 1, wherein the grid is mounted on an electrically insulating frame.

3. The packaging machine according to claim 2, wherein the frame rests substantially flush on the chamber bottom and completely surrounds the suction opening, so that during evacuation all extracted air flows through the grid.

4. The packaging machine according to claim 1, wherein the grid is fixed at a first end and a second end with one or more contact pins which project through the chamber bottom and are installed in a vacuum-tight manner.

5. The packaging machine according to claim 1, further comprising a power supply capable to supply the grid with approximately 80 to 800 watts of electrical power.

6. The packaging machine according to claim 5, wherein the grid is fixed at a first end and a second end with one or more contact pins which project through the chamber bottom and are installed in a vacuum-tight manner, and the contact pins establish an electrical connection between the grid and the power supply, the contact pins being electrically insulated against the chamber bottom.

7. The packaging machine according to claim 5, wherein the power supply has a switch-on duration of approximately 0.5 to 1.5 seconds.

8. The packaging machine according to claim 1, wherein the grid is made of an electrically conductive material.

9. The packaging machine according to claim 1, wherein the grid is made of stainless steel.

10. The packaging machine according to claim 1, wherein the grid comprises two or more webs that have a width and a height of approximately 0.5 to 1.5 mm.

11. The packaging machine according to claim 10, wherein the two or more webs have a distance from one another of approximately 8 to 10 mm.

12. The packaging machine according to claim 1, wherein the packaging machine is a chamber belt machine.

13. The packaging machine according to claim 1, wherein the grid has a length of approximately 50 to 120 mm and a width of approximately 20 to 80 mm.

14. A packaging machine for packaging products under vacuum, the packaging machine comprising:

a lid and a chamber bottom, which together define a chamber, the chamber bottom including a suction opening, wherein the suction opening is configured to be in an open state and a closed state, wherein in the closed state, the suction opening is closed in a gas-tight manner;

a suction device operably connected to the suction opening, the suction device operable to evacuate the chamber when the suction opening is in the open state; and an electrically heatable grid disposed proximate the suction opening so that during evacuation all extracted air is flowable through the grid and can be heated by the grid to inhibit ice formation at the suction opening, wherein the grid is mounted on an electrically insulating frame that rests substantially flush on the chamber bottom and completely surrounds the suction opening.

15. The packaging machine according to claim 14, wherein the grid comprises two or more webs that each have a width and a height of approximately 0.5 to 1.5 mm.

16. A packaging machine for packaging products under vacuum, the packaging machine comprising:

a lid and a chamber bottom, which together define a chamber, the chamber bottom including a suction opening, wherein the suction opening is configured to be in an open state and a closed state, wherein in the closed state, the suction opening is closed in a gas-tight manner;

a suction device operably connected to the suction opening, the suction device operable to evacuate the chamber when the suction opening is in the open state; and an electrically heatable grid disposed proximate the suction opening and operable to inhibit ice formation at the suction opening, wherein the grid is fixed at a first end and a second end with one or more contact pins which project through the chamber bottom and are installed in a vacuum-tight manner.

17. The packaging machine according to claim 16, wherein the one or more contact pins are electrically insulated against the chamber bottom.

18. The packaging machine according to claim 16, wherein the one or more contact pins are configured to establish an electrical connection between the grid and a power supply.

19. The packaging machine according to claim 18, wherein the packaging machine comprises the power supply, which is configured to supply the grid with approximately 80 to 800 watts of electrical power.

* * * * *